US009427739B2

(12) United States Patent
Suhl

(10) Patent No.: US 9,427,739 B2
(45) Date of Patent: Aug. 30, 2016

(54) RAPID THERMAL CYCLING FOR PCR REACTIONS USING ENCLOSED REACTION VESSELS AND LINEAR MOTION

(71) Applicant: Benjamin Albert Suhl, Auburn, MA (US)

(72) Inventor: Benjamin Albert Suhl, Auburn, MA (US)

( * ) Notice: Subject to any disclaimer, the term of this patent is extended or adjusted under 35 U.S.C. 154(b) by 373 days.

(21) Appl. No.: 14/051,661

(22) Filed: Oct. 11, 2013

(65) Prior Publication Data

US 2015/0104859 A1 Apr. 16, 2015

(51) Int. Cl.
*B01L 7/00* (2006.01)

(52) U.S. Cl.
CPC ..... *B01L 7/5255* (2013.01); *B01L 2300/0829* (2013.01); *B01L 2300/1805* (2013.01); *B01L 2300/1883* (2013.01)

(58) Field of Classification Search
CPC ..... B01L 2300/0829; B01L 2300/1805; B01L 2300/1883; B01L 7/5255
See application file for complete search history.

(56) References Cited

U.S. PATENT DOCUMENTS 2,793,277 A * 5/1957 Gehrke ..... D01F 9/32 219/488
2008/0038813 A1* 2/2008 Chen ..... A61B 5/1427 435/287.2
2013/0109022 A1* 5/2013 Hwang ..... B01L 7/52 435/6.12

* cited by examiner

*Primary Examiner* — Gautam Prakash

(57) ABSTRACT

A system for fast, accurate and inexpensive thermal cycling is disclosed including a set of thermally conductive plates that are maintained in a fixed spatial relationship to each other, and separated from each other by a thermal insulating space. A hole having a size approximately equal to a size of a desired test sample is formed through the set of thermally conductive plates. The test sample is placed in the hole and moved back and forth between the different temperature plates, to the desired temperature locations for desired time periods, in a pattern that is determined by the user, and repeated as many times as needed for the specific process.

14 Claims, 4 Drawing Sheets

PCR Thermal Cycling

Side view

Top view

Top view

Side view

RAPID THERMAL CYCLING FOR PCR REACTIONS USING ENCLOSED REACTION VESSELS AND LINEAR MOTION

BACKGROUND

The polymerase chain reaction (PCR) is commonly used in genetics research and manufacturing for many purposes, such as reproducing and increasing tiny DNA samples into a sample large enough for analysis. The PCR process may involve numerous cycles of a thermal cycling process to obtain the multiplicative effect, which may cause the process to extend over a long time period, resulting in increased cost and decreased number of possible situations in which the PCR may be useful.

One common present method of performing a PCR process is to take the sample, for example a DNA sample from a crime scene, place the sample in a test tube with a liquid material useful for PCR reactions and testing, and move the test tube sequentially into different temperature controlled water baths. This method may result in long cycle times due to the repeated physical motion of the test tube from one bath to another, liquids dripping from the test tubes during temperature bath switches, and increased cost due to operator employment cost or automated equipment cost.

Another method of performing a PCR process may involve placing the sample into liquid material useful for PCR reactions in a test tube and inserting the test tube into holes in an otherwise solid thermal block. The thermal block is then heated and cooled to desired temperatures in cycles necessary for the PCR to take place. This method may result in long cycle times due to the thermal inertia of the thermal block material and increased operation costs due to the power consumption associated with repeatedly heating and cooling the thermal block.

Another method of performing a PCR process may involve placing the sample into a liquid material useful for PCR reactions and testing and injecting the liquid into a long narrow sinuous channel in a thermal material layer. Applying a gaseous or liquid pressure to move the liquid sample down the sinuous narrow channel at a selected rate from one temperature area into a different temperature area and back again may result in the PCR process experiencing the desired temperature changes without the lost time, mess and cost consequent to the previously mentioned methods. This narrow sinuous channel method may experience problems with accurate temperature ranges since the two or more areas having the selected temperatures are in thermal contact with each other through the thermal material, which may result in the PCR reaction occurring at temperatures that are not exactly at the desired temperature, and may result in PCR variations from one process run to another, with the consequent loss of repeatability. This method may also suffer from potential contamination issues with the PCR material remaining on the narrow channel walls as the main mass of PCR material is moved from location to location, which may also result in inconsistent results. The accuracy of motion of the PCR material in the narrow sinuous channel may not be visible inside the thermal material, which may result in the main mass of the PCR material not being in the proper location for the correct temperature at the right time, again resulting in reduced repeatability and inconsistent results.

SUMMARY

An apparatus for performing a PCR reaction process that has improved cost, speed, accuracy and consistency as compared to current methods includes at least one thermal material plate for each desired temperature, where each of the thermal plates is separated from the other thermal plates by a thermal insulating layer. The individual thermal plates may be in direct contact with the thermal insulating layers, or may be separated by gaps. The thermal plates and interleaved thermal insulating layers may be held in a rigid position. At least one channel is formed in the thermal plates, which may typically be formed at a perpendicular angle to the plane formed by the thermal plates. The channel may extend entirely through all of the thermal plates and all of the thermal insulating layers. The size of the channel may be determined by a desired size of a PCR material vessel to be moved within the channel from thermal plate to another thermal plate at selected times and rates.

A difference in size between the channel and the PCR material vessel may be selected to be small enough to allow sufficient thermal contact between the thermal plate and the PCR material vessel to heat or cool the PCR material rapidly. A thermally conductive material may be placed inside the channel to improve the thermal conduction from the thermal plate to the PCR material vessel. The thermally conductive material may also be a lubricant.

The PCR material vessel may be a test tube, a capillary tube, a well in a plate, an ampule or any other PCR reaction vessel. The thickness of the thermal plates may be selected to be approximately the same as a selected height of the PCR material vessel, such that the entire PCR material vessel may rest as close to the thermal plate as possible during a dwell time desired for that selected temperature.

The PCR material vessels may be moved through the thermal plates by a set of rods consisting of a rod connected to the top of the PCR material vessel and a rod connected to the bottom of the PCR material vessel. The rods are each attached to a moving plate positioned above and below the set of thermal plates and thermal insulating layers, where the moving plates are each attached to a motion apparatus that manipulates the moving plates together in the direction of the channel, or channels, in the thermal plates at selected rates, distances and times.

An apparatus for the moving plates may include from one to four, or more, parallel threaded rods connected to each moving plate and to at least one motor for rotating the threaded rods for a desired number of revolutions in either direction. The threaded rods may be directly connected to both top and bottom moving plates via matching threads in the moving plates, and thus the two moving plates will move in a substantially parallel fashion, with a fixed distance between the moving plates being maintained. One exemplary apparatus may have four threaded rods, each rod connecting the top and bottom moving plates at one of four corners. Each threaded rod may be connected to a stepper motor, with each stepper motor connected to a single motor controller such that all four threaded rods move in synchrony.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views. The drawings are not necessarily to scale, emphasis instead being placed upon illustrating the principles of various embodiments of the invention.

DETAILED DESCRIPTION

Descriptions of several illustrative embodiments of the disclosed subject matter are included which provide sufficient detail for one of ordinary skill to make and use the apparatus without undue experimentation. The description is not intended to be exhaustive and the provided examples can easily be extended or combined to make other embodiments of the subject matter, which are included in the scope of the attached claims.

Figure 1:
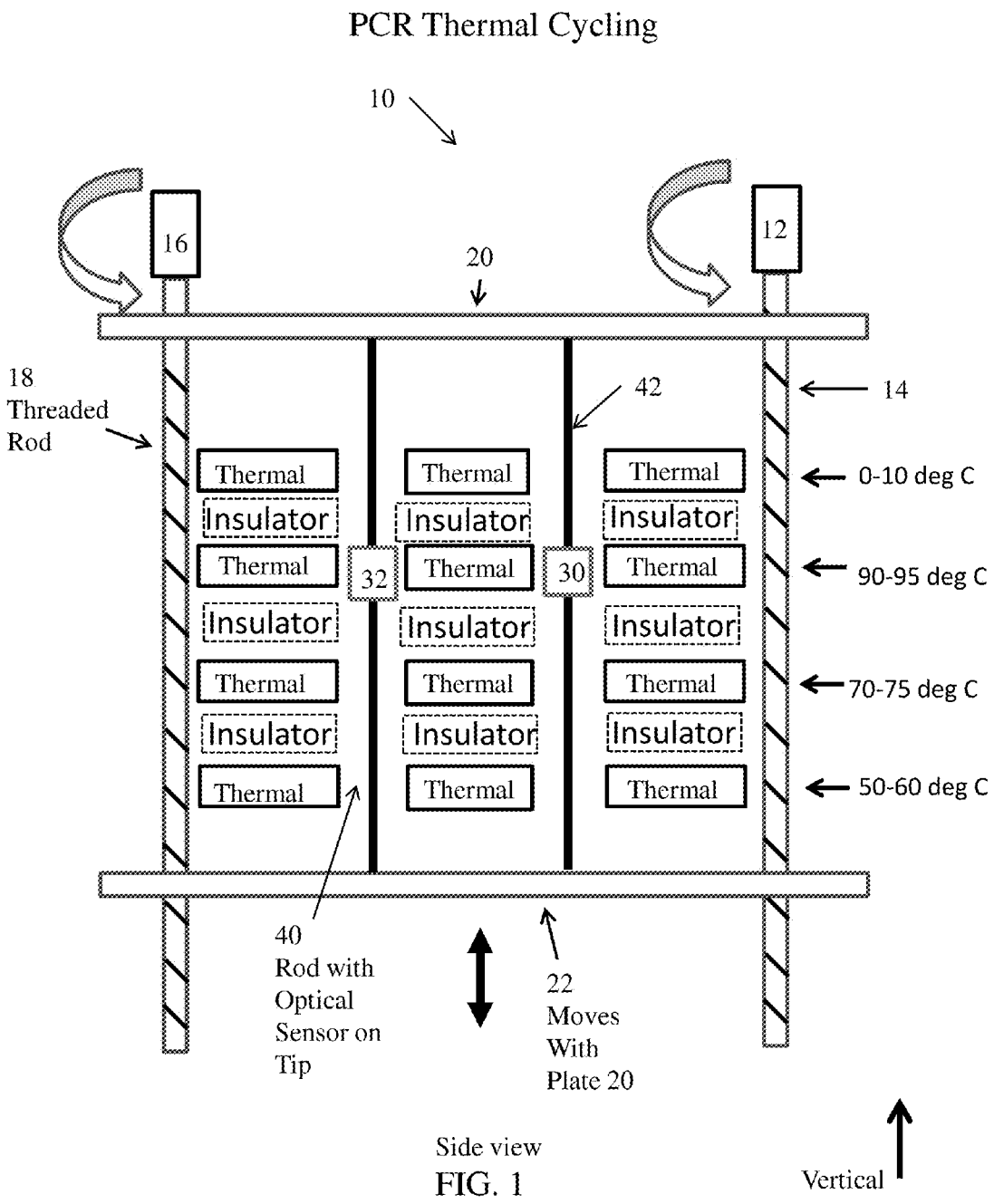
FIG. 1 is a diagram of a side view of two PCR samples moving vertically between four different temperature plates, in accordance with an embodiment of the present invention.

FIG. 1 is a diagram of a side view of two PCR samples moving vertically between four different temperature plates. The apparatus 10 includes stepper motor 12 which can rotate a selected number of small partial rotations in the counter-clockwise direction indicated by the curved arrow, or in the clockwise direction. Rotation of stepper motor 12 rotates connected threaded rod 14, which is connected, for example by a threaded hole, to moving plates 20 and 22. In a case where the accuracy of motion of the moving plates 20 and 22 have higher requirements, a second stepper motor 16 and connected threaded rod 18 may also be used, or even four or more stepper motors may be used as needed.

The moving plates 20 and 22 move thermal cycling sample container vessels 30 and 32, in this illustrative example PCR samples, but the invention is not so limited, and other thermal cycling operations may be used. The sample container vessels 30 and 32 are attached in this example to the moving plates 20 and 22 by rods 40 and 42, but the invention is not so limited and spokes, flexible cables and other attachment methods may be used. The rods 40 and 42 may be transparent plastic or glass rods with optical sensors on the tip portion adjacent to the sample container vessels 30 and 32, which may also be transparent, for real time analysis of the thermal cycling. Other sensor methods may also be used to real time monitor the thermal cycling activity.

The thermal plates labeled 0-10 degrees C., etc., are not shown as single solid plates, and single plates are not necessary. In the embodiment shown in FIG. 1 the thermal plates do not appear to be single individual plates due to the cross sectional nature of the figure, in which the view includes a side view of the channel hole formed in the plates, as will be more readily apparent from viewing the next figure, which is a top view of a similar arrangement. The thermal material plates may have thicknesses selected to match a height of the PCR sample 30 and 32, so that the entire sample may rest close to the thermal plate for rapid thermal transfer and uniformity within the sample.

The thermal plates may be directly attached to insulator layers, or may be fixed in position with air gaps, or a combination as shown in the figure. The insulators may be single plates like the thermal material plates, or may be segments as shown. In an embodiment, solid plates of thermal conductors, such as copper, and thermal insulators, such as silicon dioxide, may be bonded together, and the channels for the sample containers may be simply drilled or etched by well-known methods. The channels may have a shape and size that closely matches the sample containers 30 and 32 for efficient thermal connection between the thermal plates and the sample containers.

The sample containers may be capillary tubes with the sample positioned at a specified location within the capillary, or may be a sealed ampoule or test tube, and may be formed of glass, transparent plastic or non-transparent materials. The sample containers should be made of thermally conductive materials, or of thin materials to provide adequate thermal conductivity to allow essential matching of temperature between the sample inside the container and the thermal material within two seconds.

The channels in a solid arrangement of thermal material layers and thermal insulators may have a thermal conducting fluid added to improve thermal conductivity. The spacing between the sample container 30 and the thermal material layer may be controlled to within 0.1 mm, while the spacing between adjacent thermal layers may typically be the height of the sample container 30 and be approximately 2 mm.

An exemplary operation having one sample, or two parallel samples, may include operating the stepper motors 12 and 16 to raise the moving plates 20 and 22 to a height where the sample containers 30 and 32 are above the top thermal material layer labeled 0-10 degrees C., and thus outside the channel. The sample containers containing the samples for the thermal cycling, for example, PCR material, may be attached to the rods 40 and 42, and the stepper motors may move the sample rapidly to the second thermal plate, a hot plate labeled 90-95 degrees C. in 1-2 seconds, and stop there for a time of from 3-5 seconds. Then the stepper motors may move the sample to the third plate, a warm plate labeled 70-75 degrees C. rapidly in 1-2 seconds and stop there for a time of from 5-15 seconds. Then rapidly move the sample to the fourth plate, a cool plate labeled 50-60 degrees C. and stop there for a time of from 5-15 seconds. Then move the samples rapidly in 1-2 seconds, up to the first plate, a cold plate labeled 0-10 degrees C. for a time of 5-15 seconds, to complete a thermal cycle. The process would repeat the steps as many times as needed to complete the entire reaction, for example, a PCR reaction.

Figure 2:
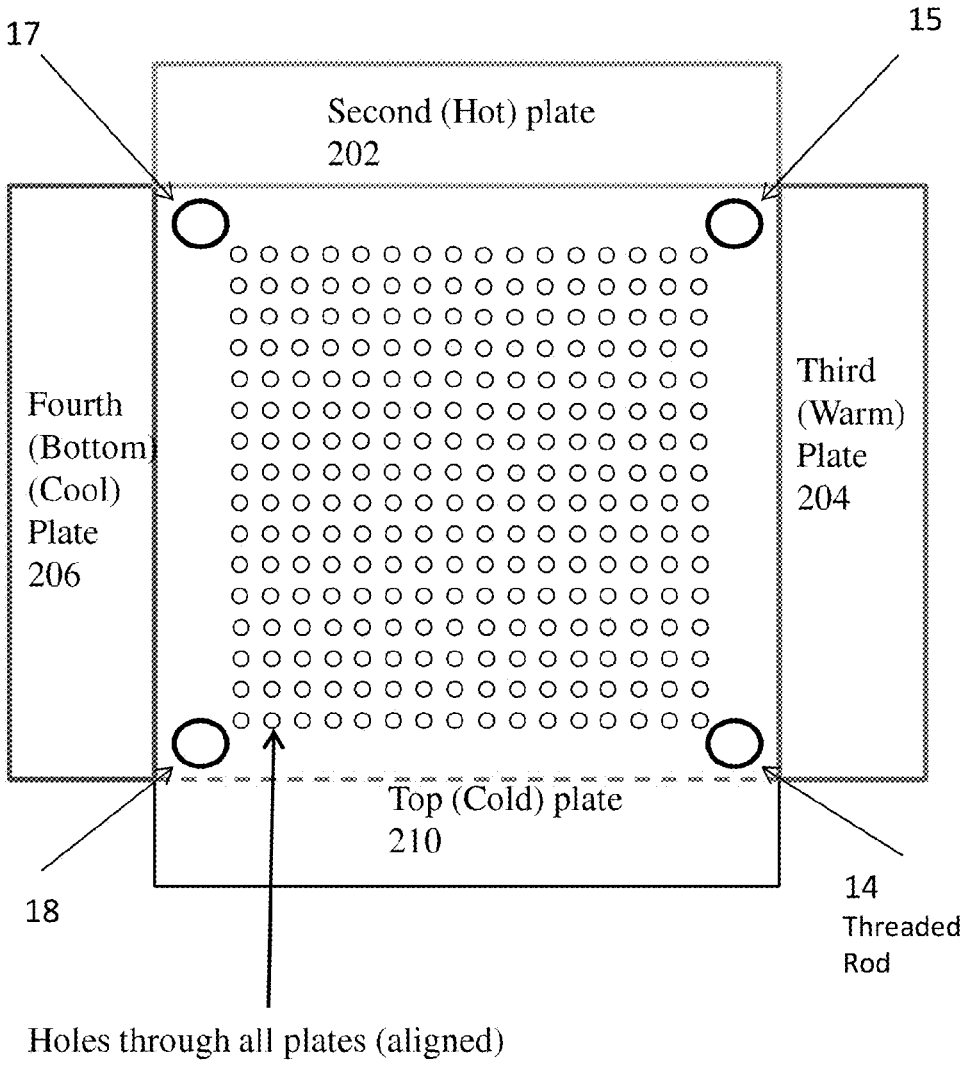
FIG. 2 is a diagram of a top view of a 16 by 16 array of holes for a parallel testing apparatus for 256 PCR samples moving vertically between four different temperature plates in similar fashion to that shown in FIG. 1, in accordance with an embodiment of the present invention.

FIG. 2 is a diagram of a top view of a 16 by 16 array of holes for a parallel testing apparatus for 256 PCR samples moving vertically between four different temperature plates in similar fashion to that shown in FIG. 1. This exemplary embodiment shows a similar apparatus to that shown in cross section in the previous figure, but with a higher degree of parallel action with different biological samples, such as might be found in a large criminology laboratory, or at an airport immigration location where the actual identity of a person may need to be positively determined.

In this arrangement the four shown different temperature plates are shown with each plate extending beyond the array area on one of the four possible directions. This enables a different heating element to be attached easily to each of the four shown thermal plates 202, 204, 206 and 210. In the shown embodiment there are four threaded rods 14, 15, 17 and 18 shown, rather than the two threaded rods of the previous figure. The number of threaded rods, or other motion drivers, can be determined depending upon the specific task.

Figure 3:
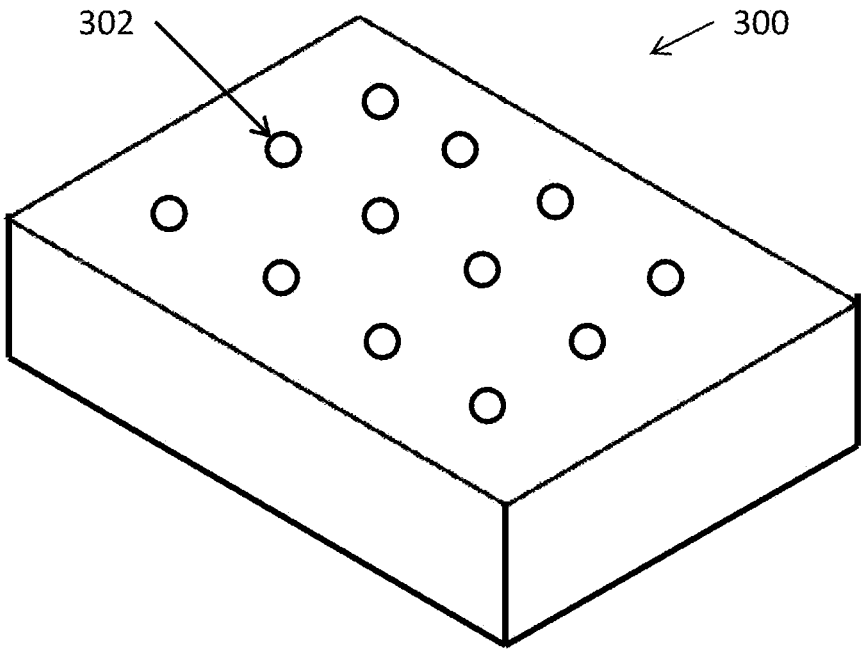
FIG. 3 is a 3D view of a 3 by 4 array of depressions in a block for a parallel testing apparatus for 12 PCR samples in a horizontal apparatus different from that shown in FIGS. 1 and 2, in accordance with an embodiment of the present invention.

FIG. 3 is a 3D view of a 3 by 4 array of depressions in a block for a parallel testing apparatus for 12 PCR samples in a horizontal apparatus different from that shown in FIGS. 1 and 2. In this illustrative embodiment the samples for thermal cycling are held in depressions 302 formed in a block 300 that may be formed of glass or other transparent or non-transparent materials. The samples are placed in the open depressions, which may typically contain about 0.1 ml of liquid and remain open topped during the thermal cycling. This may provide superior thermal contact between the heated materials and the sample since there is no obstruction to heat flow.

Figure 4:
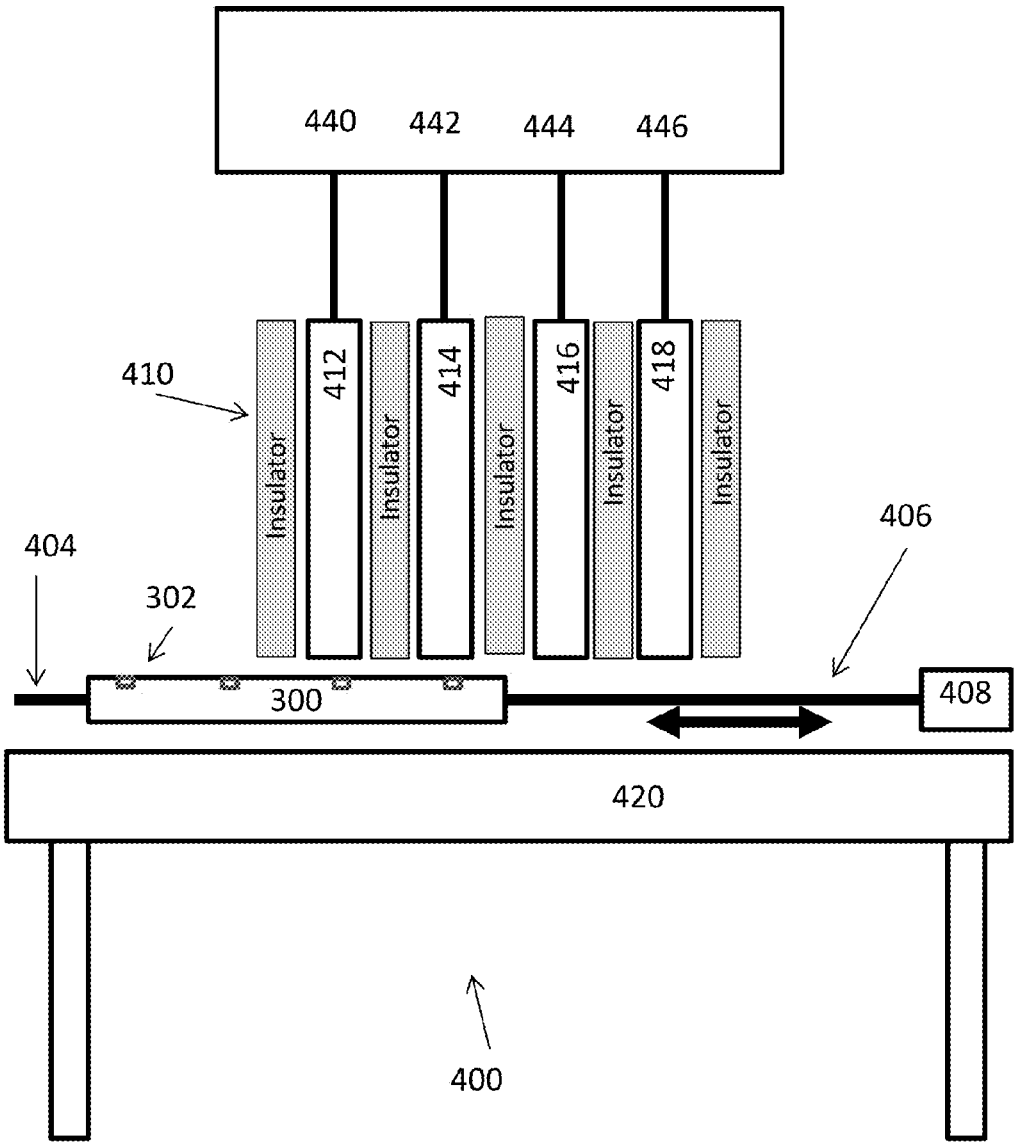
FIG. 4 is a side view of an apparatus for processing the sample block of FIG. 3, in accordance with an embodiment of the present invention.

FIG. 4 is a side view of an apparatus 400 for processing the sample block 300 of FIG. 3, in which the motion of the sample block 300 is horizontal rather than vertical. The sample block 300 containing the depressions 302 moves horizontally back and forth via the attachment rods 404 and 406 under the influence of an actuator 408, for example a motor. The sample block 300 is moved a selected distance under the heater block 410.

The sample depressions 302 are spaced apart a distance that is selected based upon a determined spacing between the individual thermal plates 412, 414, 416 and 418 of the heater block 410, such that when a first row of sample depressions is under the second heater 414, the second row of sample depression is under the first heater 412, as so on. The thermal plates 412, 414, 416 and 418 are thermally connected to respective heaters 440, 442, 444 and 446, which control the temperatures of the thermal plates 412, 414, 416 and 418.

With such an arrangement the first set of sample depressions may be rapidly moved to the first thermal plate 412, and held there for a time period sufficient to reach the first desired temperature for a selected time period. In this embodiment the selected time period may need to be the same for all the thermal steps. After the completion of the first step, the plate 300 moves rapidly forward a distance selected by the distance between the thermal plates thermal plates 412, 414, 416 and 418, so that the first row of sample depressions is now under the thermal plate 414, while the second row of sample depressions is under the first thermal plate 412. This is repeated until all rows have undergone the entire thermal cycle, and then the sample plate 300 is rapidly moved back to the starting point to repeat the thermal cycle the selected number of times.

While various embodiments of the invention have been particularly shown and described, it will be understood by those skilled in the art that various changes in form and details may be made therein without departing from the spirit and scope of the invention as defined by the appended claims.

What is claimed is:

1. An apparatus for performing a thermal cycling process, comprising:

a set of thermal material plates, each thermal material plate fixed relative to the others and separated from the others by a thermal insulating layer;

at least one channel traversing the set of thermal material plates; and a sample container vessel enabled to traverse the at least one channel to selected locations relative to selected ones of the set of thermal material plates at a selected time and rate of motion, dwell at the selected thermal material plate for a selected time periods, and traverse to another selected location repeatedly;

wherein the sample container vessel is enabled to traverse the at least one channel by a set of rods comprising:

a first rod connect to a top of the sample container vessel and to a moving plate positioned above the set of thermal material plates;

a second rod connected to a bottom of the sample container vessel, and to a moving plate positioned below the set of thermal material plates;

the moving plates are each attached to a motion apparatus that manipulates the moving plates together in the direction of the channel in the thermal material plates at selected rates, distances and times.

2. The apparatus of claim 1, wherein the thermal cycling process is a PCR reaction.

3. The apparatus of claim 1, wherein the set of thermal material plates each maintain a separate selected temperature.

4. The apparatus of claim 1, wherein the thermal insulating layer is at least one of an air gap, a plate of a thermal insulating material, and a thermally insulating liquid layer.

5. The apparatus of claim 1, wherein the individual thermal material plates may be fixed in direct contact with the thermal insulating layers, and wherein each individual thermal material plate has a thermally insulating layer both on an upper side and on a lower side.

6. The apparatus of claim 1, wherein the channel forms a perpendicular angle to a plane formed by the thermal material plates, extends through all of the set of thermal material plates and all of the thermal insulating materials, and has a size and shape selected to closely fit a sample container vessel enabled to controllably traverse the channel.

7. The apparatus of claim 6, wherein the set of thermal material plates equals four thermal material plates, a first thermal material plate maintaining a temperature of from 0-10 degrees C., a second thermal material plate maintaining a temperature of from 90-95 degrees C., a third thermal material plate maintaining a temperature of from 70-75 degrees C., and a fourth thermal material plate maintaining a temperature of from 50-60 degrees C.

8. The apparatus of claim 6, wherein the channel includes a size relative to the sample container vessel size that is selected to be close enough to allow unimpeded motion as well as sufficient thermal contact between the thermal material plate and the sample container vessel to heat and cool the PCR material to within one degree C. of an adjacent thermal material plate temperature in less than one second.

9. The apparatus of claim 8, wherein the channel includes a thermally conductive liquid material placed inside the channel to improve the thermal conduction from the thermal material plate to the sample container vessel.

10. The apparatus of claim 1, wherein the sample container vessel includes at least one of a test tube, a capillary tube, a well in a plate, and an ampule.

11. The apparatus of claim 1, wherein the motion apparatus includes:

a set of parallel threaded rods;

each threaded rod connected to each moving plate and to at least one motor;

the motor rotating the threaded rods a desired number of revolutions in at least one of two directions; and the moving plates moving a same distance in a substantially parallel fashion, with a selected distance between the moving plates.

12. The apparatus of claim 1, wherein at least one of the first rod and the second rod are formed of a transparent material and include a sensor at least at one of a point of attachment to the sample container vessel or at another point on the rod, for real time monitoring of the thermal cycling activity inside the sample container vessels.

13. The apparatus of claim 12, wherein the sample container vessel is transparent and the sensor is an optical sensor.

14. The apparatus of claim 1, wherein the at least one channel traversing the set of thermal material plates further includes a set of parallel channels.

* * * * *